US006665509B1

(12) United States Patent
Wang et al.

(10) Patent No.: US 6,665,509 B1
(45) Date of Patent: Dec. 16, 2003

(54) EJECTION MECHANISM FOR A TONER CONTAINER

(75) Inventors: Jui-Chi Wang, Taichung (TW); Robin Hsu, Taichung (TW); Ren-Hao Liu, Taichung (TW); Ya-Li Huang, Taichung (TW); Xiao Hui Wang, Taichung (TW)

(73) Assignee: General Plastic Industrial Co., Ltd. (TW)

( * ) Notice: Subject to any disclaimer, the term of this patent is extended or adjusted under 35 U.S.C. 154(b) by 0 days.

(21) Appl. No.: 10/199,390

(22) Filed: Jul. 18, 2002

(30) Foreign Application Priority Data

Jun. 11, 2002 (TW) ..... 91208785 U

(51) Int. Cl.[7] ..... G03G 15/08
(52) U.S. Cl. ..... 399/258; 399/262
(58) Field of Search ..... 399/258, 262, 399/106, 111, 113, 260, 103, 105; 222/DIG. 1, 325; 141/346, 363, 364; 220/829, 830; 292/DIG. 72

(56) References Cited

U.S. PATENT DOCUMENTS

| | | | | | |
|---|---|---|---|---|---|
| 5,520,229 | A | * | 5/1996 | Yamada | 399/262 |
| 6,014,536 | A | * | 1/2000 | Ban et al. | 399/262 |
| 6,267,263 | B1 | * | 7/2001 | Emoff et al. | 221/45 |
| 6,493,527 | B1 | * | 12/2002 | Higeta et al. | 399/111 |
| 2001/0051062 | A1 | * | 12/2001 | Yanagisawa et al. | 399/258 |

* cited by examiner

*Primary Examiner*—Arthur T. Grimley
*Assistant Examiner*—Ryan Gleitz
(74) *Attorney, Agent, or Firm*—Merchant & Gould LLC

(57) ABSTRACT

A toner container is constructed to include a toner storing portion for accommodating toner, a supply opening adapted for guiding toner from the toner storing portion to a toner receiving portion connected to the toner storing portion, a removable sealing member sealing the supply openings, and two elastic members provided at two sides of the toner storing portion and adapted for pushing the toner storing portion away from the toner receiving portion upon disengagement of the toner storing portion from the toner receiving portion.

12 Claims, 5 Drawing Sheets

EJECTION MECHANISM FOR A TONER CONTAINER

BACKGROUND OF THE INVENTION

1. Field of the Invention

The present invention relates to a toner container for use with a developing device in an image forming apparatus, for example, a copy machine and, more particularly, to an improved structure of toner container.

2. Description of the Related Art

A regular toner container for use with a developing device in a copy machine is generally comprised of a toner storing portion and a toner receiving portion fastened to the toner storing portion for receiving toner from the toner storing portion. The toner storing portion has hooks engaged in respective hook holes in the toner receiving portion. When the toner storing portion is disengaged from the toner receiving portion, the toner storing portion is ejected from the toner receiving portion by an ejecting mechanism at the toner receiving portion. The structure of this ejecting mechanism wears quickly with use. When the ejecting mechanism starts to wear, it becomes difficult to remove the toner storing portion from the toner receiving portion.

SUMMARY OF THE INVENTION

The present invention has been accomplished under the circumstances in view. In one aspect, the present invention relates to a toner container which uses elastic members to eject the toner storing portion from the toner receiving portion when the hooks of the toner storing portion are disengaged from the toner receiving portion. According to the present invention, the toner container comprises a toner storing portion for accommodating toner, a toner receiving portion for receiving toner from the toner storing portion, a supply opening provided in the bottom side of the toner storing portion and adapted for guiding toner from the toner storing portion to the toner receiving portion, a removable sealing member sealing the supply openings, and two elastic members provided at two sides of the toner storing portion and adapted for pushing the toner storing portion away from the toner receiving portion when the toner storing portion is gaged from the toner receiving portion.

DETAILED DESCRIPTION OF THE PREFERRED EMBODIMENT

Figure 1:
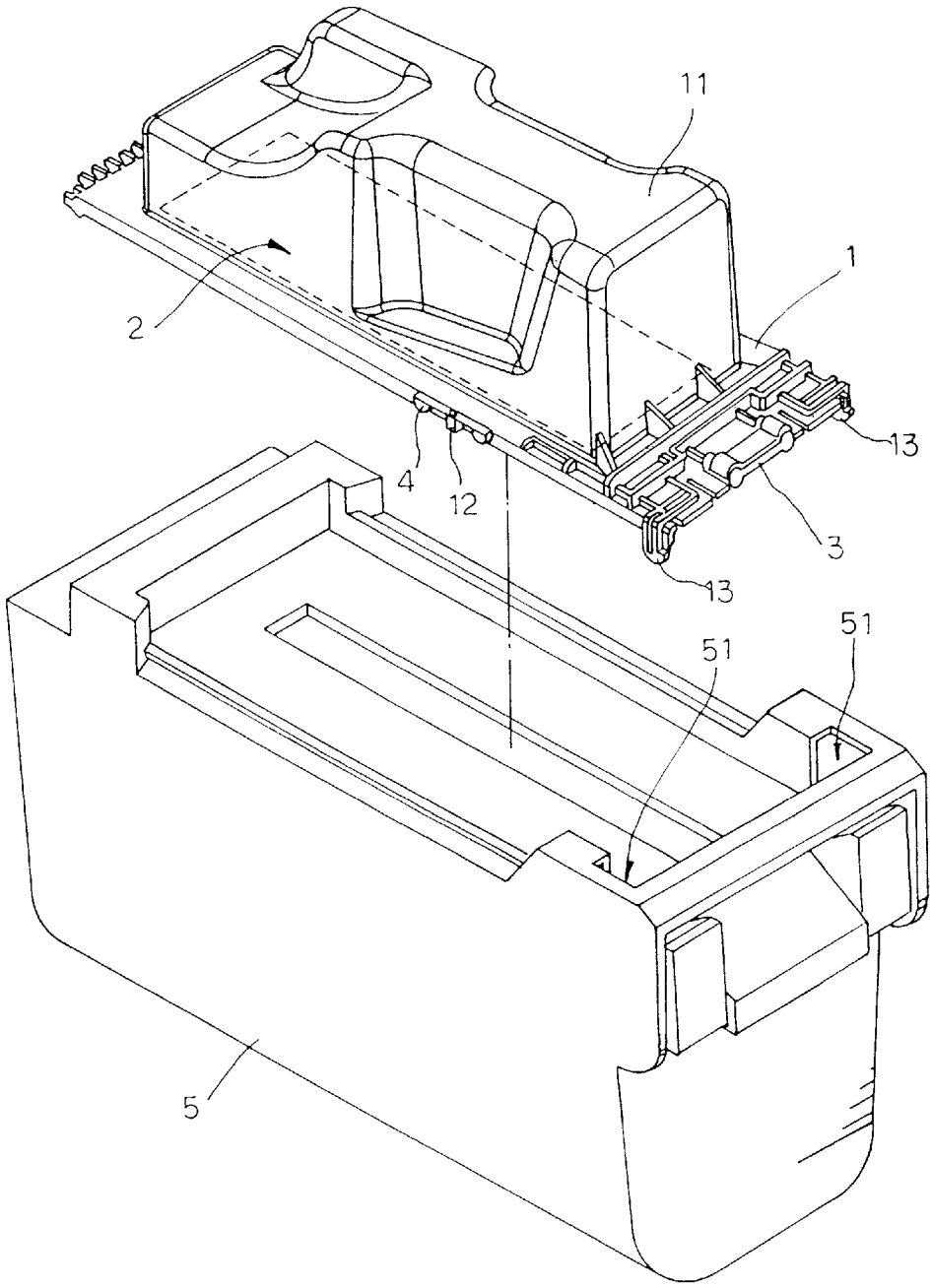
FIG. 1 is a perspective exploded view of a toner container according to the present invention.

Referring to FIG. 1, a toner container in accordance with the present invention is shown comprised of a toner storing portion 1, a supply opening 2, a removable sealing member 3, elastic members 4, and a toner receiving portion 5.

The toner storing portion 1 is the main body of the toner container, comprising an accumulation chamber 11 adapted for holding toner, two locating blocks 12 disposed at two opposite lateral sides of the toner storing portion 1, and two hooks 13 bilaterally downwardly extended from one end of the toner storing portion 1 and adapted for engaging with hook holes 51 in the toner receiving portion 5 to secure the toner storing portion 1 to the toner receiving portion 5. The supply opening 2 is provided in the bottom side (the dotted line shown in FIG. 1) of the toner storing portion 1 and adapted for supplying toner from the accumulation chamber 11 to the toner receiving portion 5. The removable sealing member 3 is fastened to the bottom side of the toner storing portion 1 to seal the supply opening 2. When the removable sealing member 3 is removed from the toner storing portion 1, the supply opening 2 is opened, enabling toner to be supplied from the accumulation chamber 11 to the toner receiving portion 5 The elastic members 4 are fixedly fastened to the locating blocks 12 of the toner storing portion 1 When the toner storing portion 1 is fastened to the toner receiving portion 5, the free ends of the elastic members 4 are pressed on the top side of the toner receiving portion 5. After the hooks 13 of the toner storing portion 1 are disengaged from the hook holes 51 of the toner receiving portion 5, the elastic members 4 are released and returned to their former shape to force the toner storing portion 1 upward away from the toner receiving portion 5.

Figure 2:
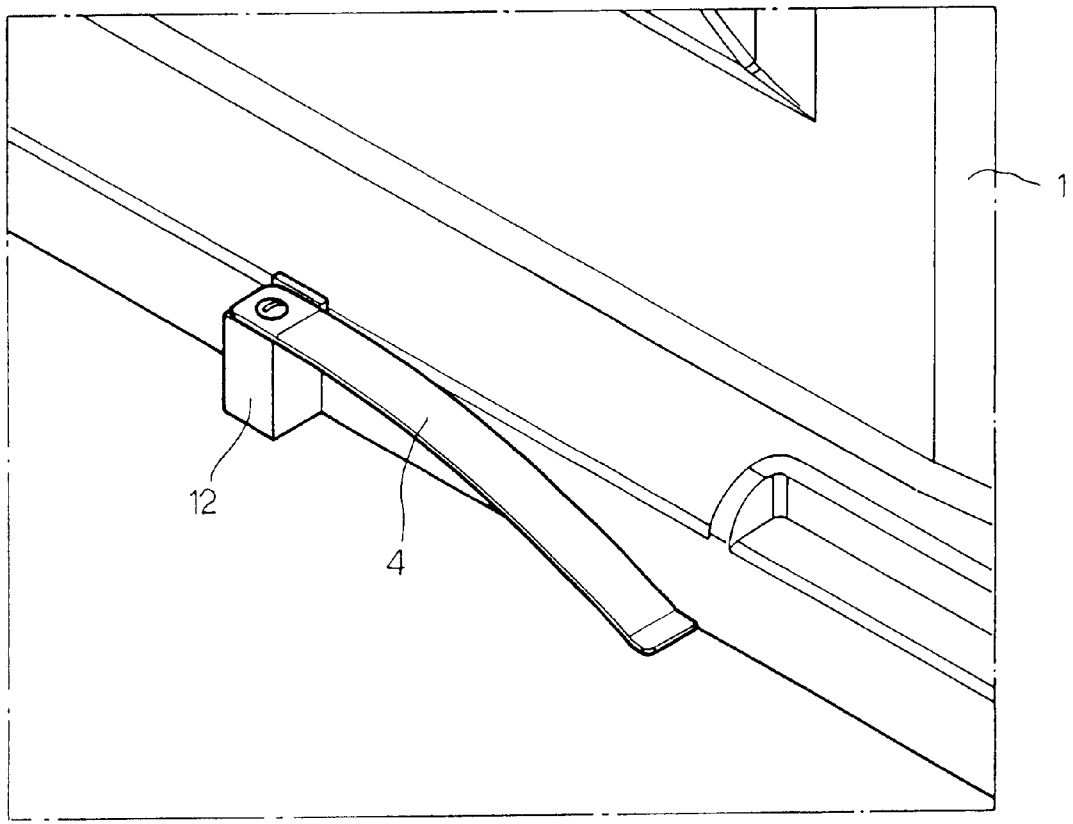
FIG. 2 is a partial view of an alternate form of the present invention.
Figure 3:
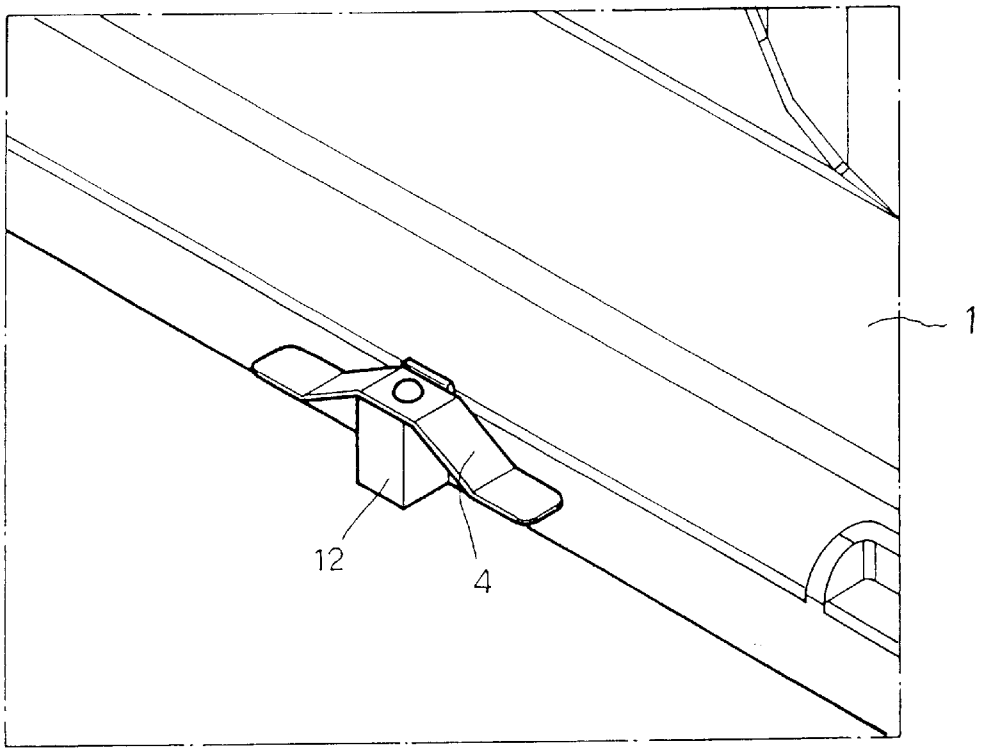
FIG. 3 is a partial view of another alternate form of the present invention.
Figure 4:
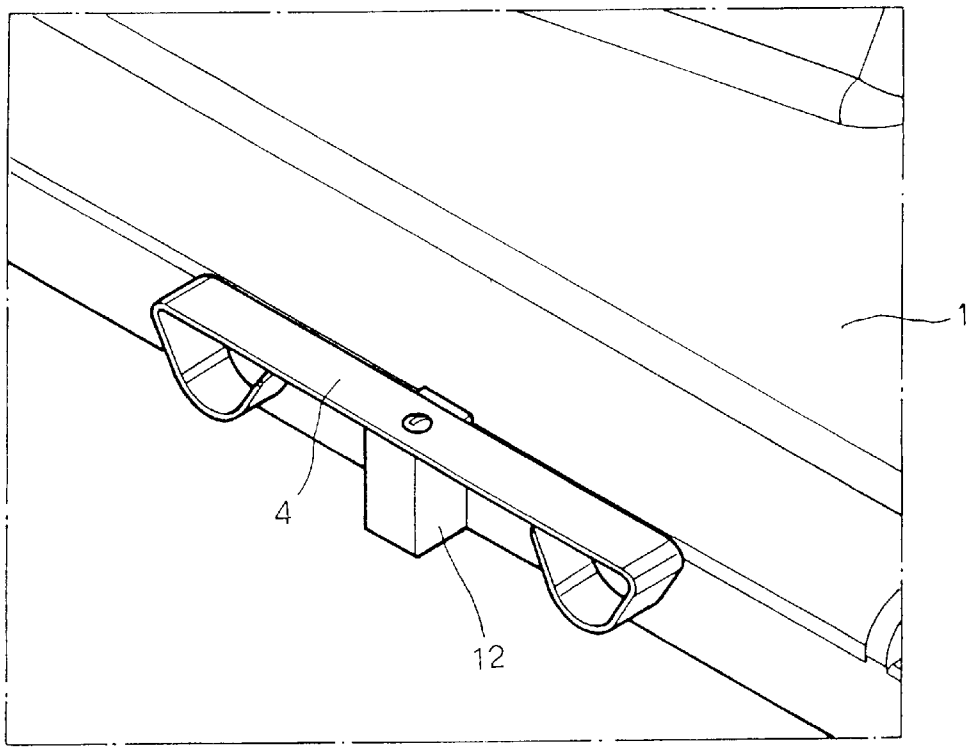
FIG. 4 is a partial view of still another alternate form of the present invention.
Figure 5:
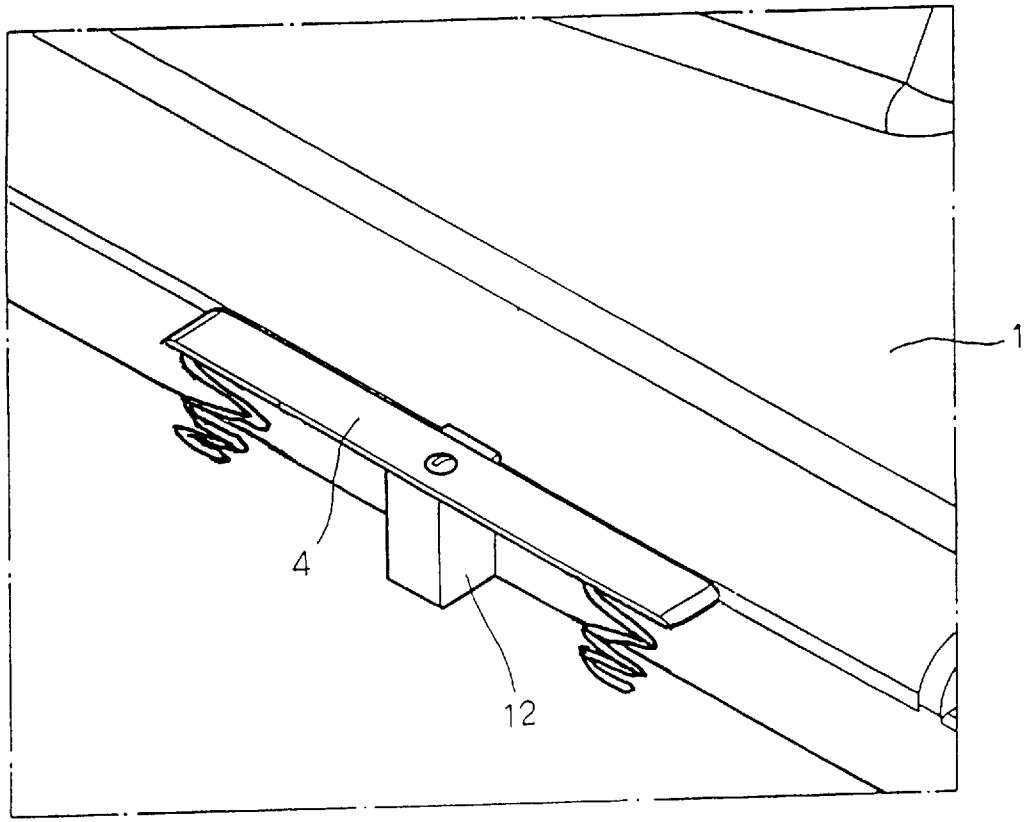
FIG. 5 is a partial view of yet another embodiment of the present invention.

The elastic members 4 may be variously embodied and installed in the toner storing portion 1 in any of a variety of forms. For example, each of the elastic members 4 can be a narrow elongated member with one end thereof fixedly fastened by a screw to the corresponding locating block 12, leaving the other end of each of the elastic members 4 free for pressing on the toner receiving portion as shown in FIG. 2; each of the elastic members 4 can be shaped like an arched member having a middle part riveted to the corresponding locating block 12 and having two distal ends free for pressing on the toner receiving portion as shown in FIG. 3; or each of the elastic members 4 can be made having a middle part fixedly fastened to the corresponding locating block 12 by a screw and two distal ends turned inwards for pressing on the toner receiving portion as shown in FIG. 4. Further, each of the elastic members 4 can be made of a spring coil as shown in FIG. 5 or spring plate, and each of the elastic members 4 can be fastened to the toner storing portion 1 by a glue, hook joint, or the like.

A prototype of toner container has been constructed with the features of FIGS. 1~4. The toner container functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A toner container comprising:

a toner storing portion adapted for accommodating toner, wherein the toner storing portion has a bottom side defining a supply opening and having two opposite lateral sides along a longitudinal axis of the toner storing portion;

a toner receiving portion adapted for receiving toner from the supply opening of the toner storing portion and having two top sides adapted for receiving corresponding two lateral sides of the toner storing portion;

a removable sealing member fastened to the toner storing portion to close the supply opening;

a locating block disposed at and projecting away from one of the lateral sides of the toner storing portion; and an elastic member having a body portion and a free end, wherein the body portion of the elastic member is supported by the locating block, and the free end of the elastic member is longitudinally projecting away from the locating block and substantially parallel to the corresponding lateral side of the toner storing portion where the locating block is disposed, and wherein when the toner storing portion engages with the toner receiving portion, the free end of the elastic member contacts with one of the top sides of the toner receiving portion, and when the toner storing portion disengages from the toner receiving portion, the free end of the elastic member pushes the toner storing portion away from the toner receiving portion.

2. The toner container as claimed in claim 1, wherein the toner storing portion further comprises at least one hook bilaterally downwardly extended from one end of the toner storing portion, and wherein the toner receiving portion further comprises at least one hook hole adapted for receiving the at least one hook to engage the toner storing portion with the toner receiving portion.

3. The toner container as claimed in claim 1, wherein the elastic member comprises a spring coil.

4. The toner container as claimed in claim 1, wherein the elastic member comprises a spring plate.

5. A toner container comprising:

a toner storing portion adapted for accommodating toner, wherein the toner storing portion has a bottom side defining a supply opening and having two opposite lateral sides along a longitudinal axis of the toner storing portion, and two locating blocks, each disposed at and projecting away from one of the lateral sides of the toner storing portion and adapted for holding one of the elastic members;

a toner receiving portion adapted for receiving toner from the supply opening of the toner storing portion and having two top sides adapted for receiving corresponding two lateral sides of the toner storing portion;

a removable sealing member fastened to the toner storing portion to close the supply opening; and two elastic members, each fastened to one of the lateral sides of the toner storing portion and each having a body portion and a free end, wherein the body portion of the elastic member is supported by one of the two locating blocks, and the free end of the elastic member is longitudinally projecting away from the corresponding locating block and substantially parallel to the corresponding lateral side of the toner storing portion where the locating block is disposed, and wherein when the toner storing portion engages with the toner receiving portion, the free end of the elastic member contacts with one of the top sides of the toner receiving portion and the elastic member deforms elastically, and when the toner storing portion disengages from the toner receiving portion, the elastic member elastically returns to its former shape and the free end of the elastic member pushes the toner storing portion away from the toner receiving portion.

6. The toner container as claimed in claim 5, wherein the toner storing portion further comprises at least one hook bilaterally downwardly extended from one end of the toner storing portion, and wherein the toner receiving portion further comprises at least one hook hole adapted for receiving the at least one hook to engage the toner storing portion with the toner receiving portion.

7. The toner container as claimed in claim 5, wherein each of the elastic members comprises a spring plate.

8. The toner container as claimed in claim 5, wherein each of the elastic members comprises a spring coil.

9. A toner container comprising:

a toner storing portion adapted for accommodating toner, wherein the toner storing portion has a bottom side defining a supply opening and having two opposite lateral sides along a longitudinal axis of the toner storing portion, and at least one locating block disposed at and projecting away from one of the lateral sides of the toner storing portion and adapted for holding the elastic member;

a toner receiving portion adapted for receiving toner from the supply opening of the toner storing portion and having two top sides adapted for receiving corresponding two lateral sides of the toner storing portion;

a removable sealing member fastened to the toner storing portion to close the supply opening; and at least one elastic member fastened to one of the lateral sides of the toner storing portion and a body portion and a free end, wherein the body portion of the elastic member is supported by the locating block, and the free end of the elastic member is longitudinally protecting away from the locating block and substantially parallel to the corresponding lateral side of the toner storing portion where the locating block is disposed, and wherein when the toner storing portion engages with the toner receiving portion, the free end of the elastic member contacts with one of the top sides of the toner receiving portion and the elastic member deforms elastically, and when the toner storing portion disengages from the toner receiving portion, the elastic member elastically returns to its former shape and the free end of the elastic member pushes the toner storing portion away from the toner receiving portion.

10. The toner container as claimed in claim 9, wherein the toner storing portion further comprises at least one hook bilaterally downwardly extended from one end of the toner storing portion, and wherein the toner receiving portion further comprises at least one hook hole adapted for receiving the at least one hook to engage the toner storing portion with the toner receiving portion.

11. The toner container as claimed in claim 9, wherein the elastic member comprises a spring plate.

12. The toner container as claimed in claim 9, wherein the elastic member comprises a spring coil.

* * * * *